US005984271A

United States Patent [19]

Ellenberger

[11] Patent Number: 5,984,271

[45] Date of Patent: Nov. 16, 1999

[54] SLIDE TAPPER FOR TONGUE-IN-GROOVE FLOORING

[76] Inventor: Jack Richard Ellenberger, 8355 NE. Loughrey Ave., Indianola, Wash. 98342

[21] Appl. No.: 09/207,392

[22] Filed: Dec. 8, 1998

[51] Int. Cl.[6] ..... B66F 3/00

[52] U.S. Cl. ..... 254/11; 81/46; 81/463; 29/254

[58] Field of Search ..... 254/11; 29/254, 29/255, 525, 278; 173/90, 91, 128; 81/46, 463

[56] References Cited

U.S. PATENT DOCUMENTS

| | | | |
|---|---|---|---|
| 1,161,207 | 11/1915 | Hagel | 81/46 |
| 2,010,575 | 8/1935 | White . | |
| 2,702,060 | 2/1955 | Bonnesen . | |
| 3,568,657 | 3/1971 | Gue . | |
| 3,844,321 | 10/1974 | Cook . | |
| 3,939,546 | 2/1976 | Hernandez | 254/11 |
| 4,624,323 | 11/1986 | Burrola . | |
| 5,435,610 | 7/1995 | Roberts | 254/11 |
| 5,461,900 | 10/1995 | Gutierrez . | |
| 5,819,393 | 10/1998 | Bockart et al. | 29/525 |
| 5,845,548 | 12/1998 | Nelson | 81/46 |
| 5,894,705 | 4/1999 | Sutton | 254/11 |

*Primary Examiner*—Robert C. Watson
*Attorney, Agent, or Firm*—Gene Scott-Patent Law & Venture Group

[57] ABSTRACT

A slide hammer has end blocks of a material that will not damage wooden boards when it is used to tap the boards into place. The slide hammer includes a slide rod or bar and a weighted hammer movable on the slide rod. With one of the end blocks in contact with a board, the hammer is moved into contact with one of the end blocks in a vigorous manner to drive the board into place. The edges of the end blocks are configured so as to allow the unit to be positioned in tight spaces between the boards and any surrounding walls.

4 Claims, 2 Drawing Sheets

SLIDE TAPPER FOR TONGUE-IN-GROOVE FLOORING

BACKGROUND OF THE INVENTION

1. Field of the Invention

This invention relates generally to slide hammers, and more particularly to a slide hammer of special configuration for tapping tongue-in-groove boards into place.

2. Description of Related Art

The following art defines the present state of this field:

Gutierrez, U.S. Pat. No. 5,461,900 describes a device for use in the repair of automobiles, trucks, farm equipment and other vehicles having sheet metal bodies capable of deformation from impact accidents. This device includes a main body portion having a first nestable solid section and a second tubular receiving section the receiving section being constrictedly open at its proximal end. The receiving section being closed on its distal end by a closure which is threaded to receive a work head of varying configurations, each of which is interchangeable with the other for carrying out specific tasks or functions within a specific area of the vehicular body.

Burrola, U.S. Pat. No. 4,624,323 describes an improved multi-purpose impact hand tool kit for use by electricians, carpenters or similar tradesperson in the building construction industry or other similar industry in applications that require the use of an impact type of hand tool for driving fastening devices such as concrete nails, threaded or unthreaded fastener studs, pins anchor/expansion plugs or similar devices. The improved impact hand tool kit conveniently provides for the tradesperson an elongated shaft provided with a tool end having exterior threads and a threaded bore for attaching male or female threaded attachment ends provided on commercially available fastening devices. The improved hand tool kit can also be used by the tradesperson in general applications that require the use of an impact or non-impact general purpose hand tools such as chisels, punches, and screwdrivers. Such impact or non-impact general purpose hand tools are specially adapted for use with the elongated shaft of the improved impact hand tool kit. The improved impact hand tool kit is also provided with simple reducer adapters which will allow the use of fastening devices or specially adapted general purpose impact or non-impact hand tools having their attachment ends with a reduced thread size. The improved impact hand tool kit is provided with features that add utility, comfort, durability and safety during its use.

Cook, U.S. Pat. No. 3,844,321 describes an impact tool in which a specifically configured skeletal stiffener is completely and unitarily encased in a thick resilient encasement. The part of the skeletal stiffener which forms the basis for the striking head of the tool may be internally provided with operatively movable and treated particles to inhibit any recoil of the head when an object is struck.

Gue, U.S. Pat. No. 3,568,647 describes an elongated rock-breaking bar providing one end with a chisel point and at the opposite end with a chisel edge. Intermediate these ends are a pair of longitudinally spaced collars between which a hammer member is mounted slidable on the bar. In one embodiment the bar is made in two detachable longitudinal sections and the hammer member is made in one piece. In another embodiment the bar is made in one piece and the hammer member is made in two detachable lateral sections.

Bonnesen, U.S. Pat. No. 2,702,060 describes a handled instrument or tool having a blow head. The tool comprises an elongated handle member which has large diameter collar inwardly of and adjacent one end thereof. A head mounted on the handle member outwardly of the collar. At the end of the handle member securing the head against displacement from the handle member is an annular bushing of sock absorbing material spacing the handle member from the head. The bushing includes shock absorbing flanges disposed between the head, collar and head securing means. The other end of the handle member has a roughened surface and a hand-grip portion of shock absorbing material fixed to the roughened surface.

White, U.S. Pat. No. 2,010,575 describes a bung-driver or hammer device of the type comprising an elongated body affording a hand-grip and having one end enlarged to form a hammer-head. The body and head being formed with an axial bore and with a coextensive open slot from end to end to permit emplacement of the hammer laterally upon a pipe. The device has a resilient cushion supported by a metal plate secured removably to the hammer-head and having a slot registering with that of the slot and bore of the handle body and further characterized by having the cushion-supporting plate provided with spaced central projections embedded in the body of the cushion, and with marginal abutment projections adjacent to the slotted end of the cushion.

The prior art teaches slide hammers of various types. However, the prior art does not teach that a slide hammer may be configured for fitting in small and large spaces as required in board laying. The present invention fulfills these needs and provides further related advantages as described in the following summary.

SUMMARY OF THE INVENTION

The present invention teaches certain benefits in construction and use which give rise to the objectives described below.

The present invention provides a slide hammer having end blocks of a material that will not damage wooden boards when it is used to tap the boards into place. The slide hammer includes a slide rod or bar and a weighted hammer movable on the slide rod. With one of the end blocks in contact with a board, the hammer is moved into contact with one of the end blocks in a vigorous manner to drive the boards into place. The edges of the end blocks are configured so as to allow the unit to be positioned in tight spaces between the boards and any surrounding walls.

A primary objective of the present invention is to provide a slide hammer having advantages not taught by the prior art.

Another objective is to provide a slide hammer having several side edge face lengths so as to be used in a variety of tight fitting situations.

A further objective is to provide such a slide hammer having a means for preventing a finger from being caught between the hammer and the end blocks.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 2:
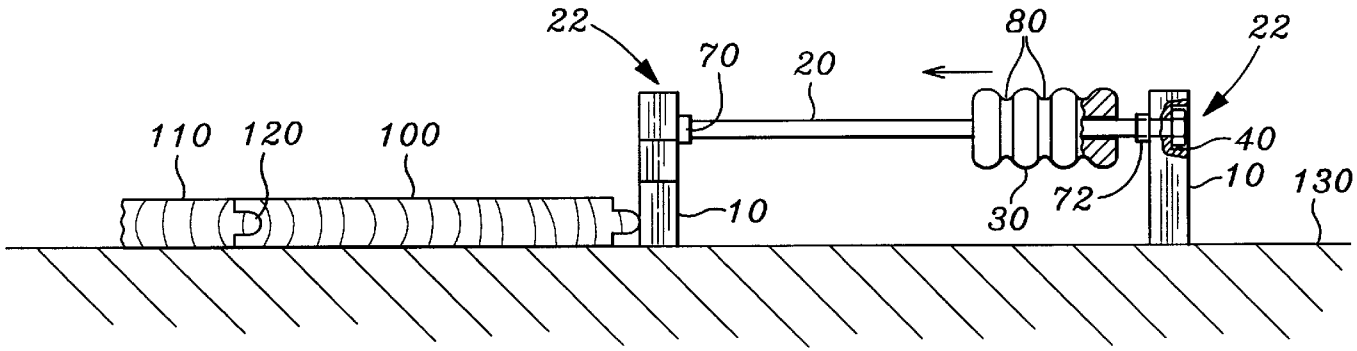
FIG. 2 is a side elevational view thereof.
Figure 3:
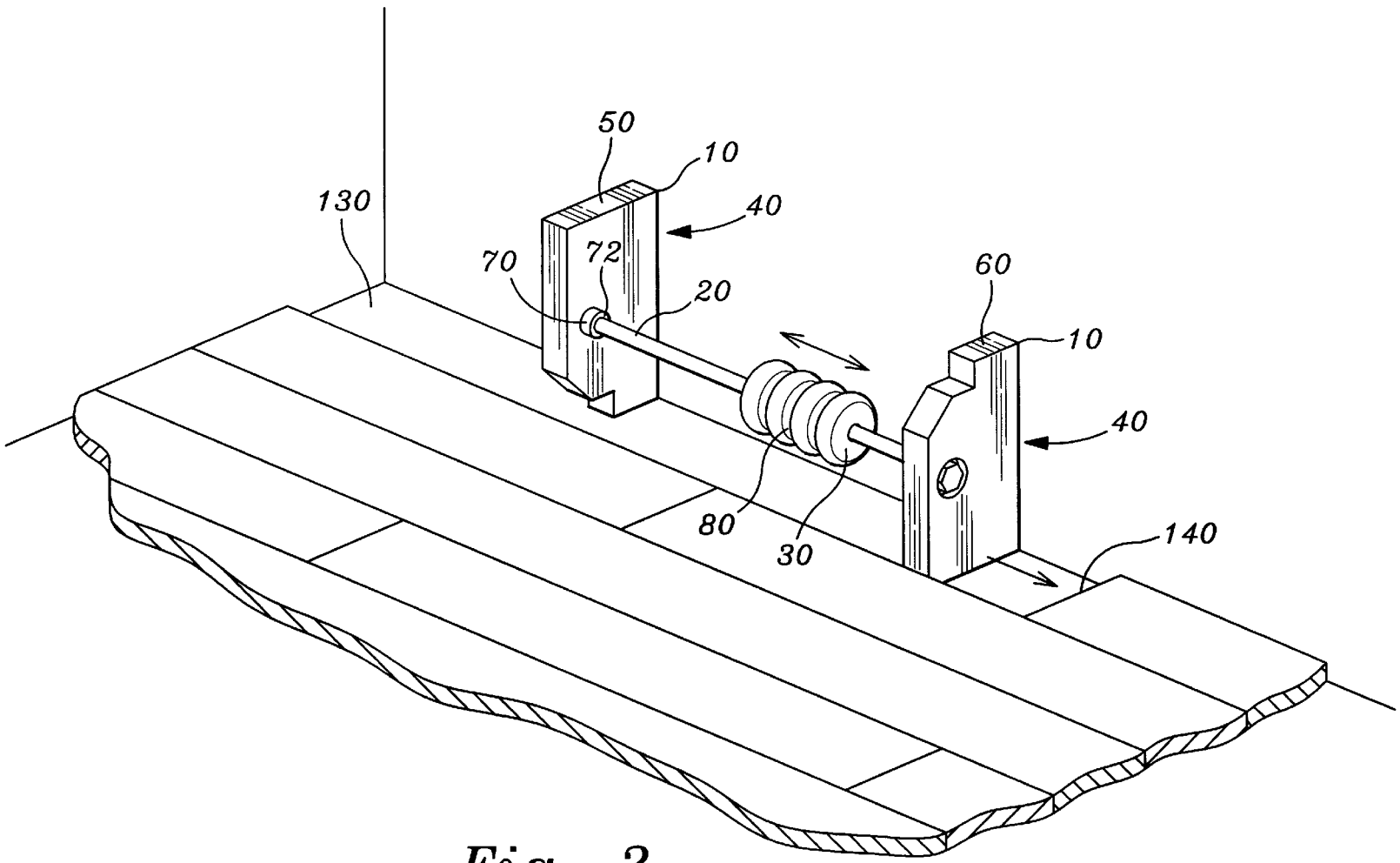
FIG. 3 is a perspective view thereof showing an alternate manner of use of the invention.

The above described drawing figures illustrate the invention, an apparatus comprising a pair of spaced apart end blocks 10, preferably made of wood, resilient plastic, rubberized plastic or other material of a mechanical shock absorbing nature, joined by a rigid slide rod 20, preferably of aluminum, steel or other rigid structural material, extending therebetween and fixedly fastened thereto. The slide rod 20 is preferably fastened to the end blocks 10 on each of its ends 22, as shown in FIG. 2, by a nut 24 threaded onto the end of the slide rod 22, where the nut 24 is fitted within a counterbore 12 or blind hole as shown so that the terminal surfaces 14 of the end blocks 10 are not obstructed by any protrusion and therefore the apparatus may be stood-up on the surface 14 in a corner until needed. A hammer body 30, preferably made of a heavy metal such as wrought iron or steel, has a mass density greater than the end blocks 10 and preferably of such magnitude as to enable the apparatus to impart a significant amount of energy to the end blocks by striking them with the hammer body 30, the hammer body 30 being slidably mounted on the slide rod 20 so as to be movable between the end blocks 10. Preferably, each of the end blocks is generally rectangular in shape so as to provide three opposing perimeter planar edges 40, 50, 60, the planar edges laying in planes parallel to the slide rod 20. The three planar edges comprise in length, a larger one of the planar edges 40, a medial one of the planar edges 50 and a smaller one of the planar edges 60. The larger one of the planar edges 40 of each of the pair of end blocks 10 is positioned in corresponding attitudes relative to the slide rod 20 so that the end blocks 10 may be placed onto a surface with the larger one of the planar edges 40 of both of the end blocks 10 simultaneously resting in contact with the surface as clearly shown in FIGS. 1 and 2. The medial ones 50 and the smaller ones 60 of the planar edges are preferably positioned in opposing attitudes relative to the slide rod 20 so that the end blocks 10 may be placed onto a surface with the medial one of the planar edges 50 of one of the end blocks 10 and the smaller one of the planar edges 60 of the other of the end blocks 10 simultaneously resting in contact with the surface as shown in FIG. 3.

Preferably, the slide rod 20 further includes a pair of rod sleeves 70, each of the rod sleeves being fixed over the slide rod 20 and abutting one of the end blocks 10, each said rod sleeve 70 being of such length and size as to directly receive blows of the hammer body on a distal annular rim 72 of the rod sleeve 70. Preferably, each of the rod sleeves 70 has a length sufficient to avoid pinching a finger between the hammer body 30 and the corresponding end block 10. Further, the hammer body 30 preferably provides a series of annular grooves 80 therein for providing improved grasping of the hammer body 30.

Figure 1:
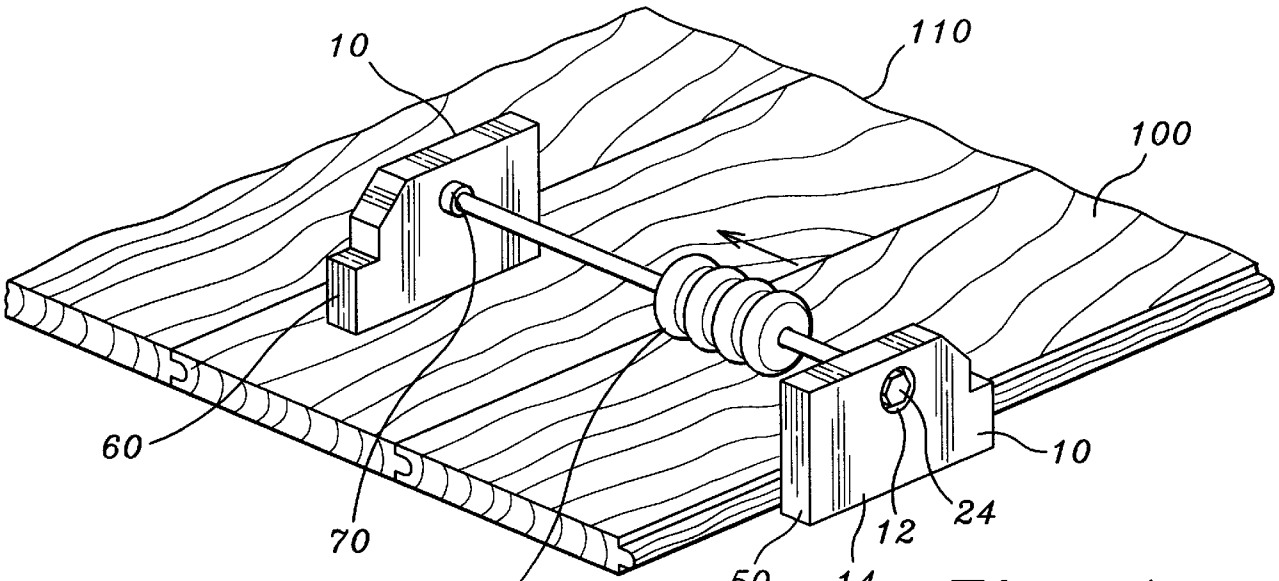
FIG. 1 is a perspective view of the preferred embodiment of the present invention.

In use, the apparatus is generally used to tap the end of a floor board or other tongue-in-groove element into place. Such tongue-in-groove structures are in widespread use for floor, wall and ceiling coverings as well as for exterior construction and many other applications as well. In FIG. 2, board 100 is being tapped into board 110 by the apparatus. An arrow shown near the hammer body 30 shows the direction in which the hammer body 30 is moved, preferably at a rapid rate until the hammer body 30 collides with the rod sleeve 70 at the left of the illustration in FIG. 2. The hammer body 30 is moved by hand, and is able to impart its kinetic energy to the end block 10 (at left of FIG. 2), which in-turn imparts such energy to board 100 driving the tongue 120 of board 110 into the slot of board 100. It should be noticed that in FIG. 2, the apparatus is positioned in contact with a sub-floor 130. Alternately, when space does not permit the entire apparatus to be positioned on the sub-floor, the apparatus may be positioned, as shown in FIG. 1, where the hammer body 30 is moved, as in FIG. 2, from right to left, striking the end block 10 at the left, but the impact is transferred through the slide rod 20 to the end block 10 at the right so as to drive board 100 into board 110. In FIGS. 1 and 2 we see that the larger one of the planer edges 40 of both of the end blocks are in contact with the surfaces upon which the apparatus is rested. In a further utilization of the structural elements of the invention, FIG. 3 shows the means by which the apparatus may be used to drive a narrow end 140 of the board 100. In this case enough space is available to accommodate the medial one of the planar edges 50. When even less space is available for placement of the apparatus onto the sub-floor 130, the smaller one of the planar edge 60 may be used. This illustrates and explains the primary advantages of the apparatus with respect to using this tool in its several approaches to laying floor boards, but the same approaches may be applied to wall, ceiling, and other board laying applications and to other applications where tapping is required.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus comprising:

a pair of spaced apart end blocks joined by a slide rod extending therebetween and fixedly fastened thereto;

a hammer body having a mass density greater than the end blocks, the hammer body being slidably mounted on the slide rod so as to be movable between the end blocks;

each of the end blocks being of a generally rectangular shape so as to provide three opposing perimeter planar edges, the planar edges laying in planes parallel to the slide rod;

the three planar edges comprising in length, a larger one of the planar edges, a medial one of the planar edges and a smaller one of the planar edges;

the larger one of the planar edges of each of the pair of end blocks being positioned in corresponding attitudes relative to the slide rod so that the end blocks may be placed onto a surface with the larger one of the planar edges of both of the end blocks simultaneously resting in contact with the surface;

the medial ones and the smaller ones of the planar edges being positioned in opposing attitudes relative to the slide rod so that the end blocks may be placed onto a surface with the medial one of the planar edges of one of the end blocks and the smaller one of the planar edges of the other of the end blocks simultaneously resting in contact with the surface.

2. The apparatus of claim 1 further comprises a pair of rod sleeves, each one of the rod sleeves being fixed over the slide rod and abutting one of the end blocks, each said rod sleeve being of such length and size as to directly receive blows of the hammer body on a distal annular rim of the rod sleeve.

3. The apparatus of claim 2 wherein each of the rod sleeves has a length sufficient to avoid pinching a finger between the hammer body and the corresponding end block.

4. The apparatus of claim 1 wherein the hammer body provides a series of annular grooves therein for providing improved grasping of the hammer body.

* * * * *